United States Patent [19]

Beaton

[11] 4,021,335

[45] May 3, 1977

[54] METHOD FOR UPGRADING BLACK OILS

[75] Inventor: William Ingram Beaton, Wheaton, Ill.

[73] Assignee: Standard Oil Company (Indiana), Chicago, Ill.

[22] Filed: June 17, 1975

[21] Appl. No.: 587,631

[52] U.S. Cl. ..... 208/309; 208/251 R

[51] Int. Cl.[2] ..... C10G 21/14

[58] Field of Search ..... 208/11 LE, 309, 251 R

[56] References Cited

UNITED STATES PATENTS

| | | | |
|---|---|---|---|
| 2,825,677 | 3/1958 | Coulson | 208/11 LE |
| 2,871,180 | 1/1959 | Lowman et al. | 208/11 LE |
| 3,331,765 | 7/1967 | Canevari et al. | 208/11 LE |
| 3,779,895 | 12/1973 | Wilson et al. | 208/309 |
| 3,779,902 | 12/1973 | Mitchell et al. | 208/309 |
| 3,893,907 | 7/1975 | Canevari | 208/11 LE |

FOREIGN PATENTS OR APPLICATIONS

| | | | |
|---|---|---|---|
| 1,384,290 | 2/1975 | United Kingdom | 208/309 |

*Primary Examiner*—Herbert Levine
*Attorney, Agent, or Firm*—Richard A. Kretchmer; Arthur G. Gilkes; William T. McClain

[57] ABSTRACT

A method for removing ash, asphaltenic, metallic and sulfurous contaminants from a black oil by contacting said oil with a liquid paraffinic solvent in the presence of water.

11 Claims, No Drawings

METHOD FOR UPGRADING BLACK OILS

BACKGROUND OF THE INVENTION

1. Field of the Invention

This invention pertains to a method for upgrading black oil and, in particular to a method for removing ash, asphaltenic, metallic and sulfurous contaminants from a black oil by contacting said oil with a liquid paraffinic solvent in the presence of water.

2. Description of the Prior Art

Heavy hydrocarbon fractions like atmospheric tower bottoms products, vacuum tower bottoms products (vacuum residuum), shale oils, coal oils and tar sands are commonly referred to in the art as "black oils" and contain appreciable amounts as asphaltenic material. Asphaltenes are present in black oils in a colloidal state. The high molecular weight asphaltenes are generally complexed or linked with sulfur and organometallic contaminants. In addition, many black oils contain finely divided particulate ash. The ash consists principally of alumino-silicates having nominal diameters in the range of about 1.0 to about 10.0 microns.

Such contaminants in black oils rapidly poison the catalyst which are generally employed in catalytic processes such as catalytic cracking and hydroprocessing and have a strong corrosive effect on metallic equipment and cause damage to refractory materials. In addition, the finely divided ash particles have extremely sharp edges and are, therefore, excessively abrasive. Because of these deleterious characteristics, a variety of processes have been employed to remove such contaminants from black oils.

Deasphalting is one such technique for separating such contaminants from the non-asphaltenic fraction of a black oil. The resulting deasphalted fraction contains only a small portion of the original ash, metallic and sulfurous contaminants and virtually no asphaltenes. Deasphalting improves the quality of a heavy hydrocarbon fraction by lowering the viscosity, by reducing the ash, metals and sulfur content, and by rejecting the asphalt fraction.

In deasphalting, a black oil feed is contacted with a relatively large volume of a deasphalting solvent, generally in a counter-current contactor with the inlet for the oil feed being located above the inlet for the solvent. Upon contact of the solvent with the oil feed, the colloidal state of the asphaltenes is broken down, causing the asphaltenes to flocculate and settle out of the oil phase, taking much of the ash, metallic and sulfurous contaminants with them; and a second phase is formed which contains substantially all of the asphaltenes and a substantial proportion of the ash, metallic, and sulfurous contaminants. A deasphalted hydrocarbon or oil phase exits from the top region of the contactor, and a predominantly asphaltene phase exits from the bottom region of the contactor. The solvent is next flashed and stripped from both the deasphalted hydrocarbon phase and the asphaltene phase and then condensed and returned to the contactor.

A deasphalting solvent is one in which the asphaltenic materials are relatively insoluble but which is miscible with the hydrocarbon components of the black oil. Typically, liquefied propane is used as a deasphalting solvent. However, propane is a poor solvent for resins as well as asphaltenes, and thus a propane solvent rejects large amounts of useful hydrocarbons as well as the asphaltenes. Consequently, the yield of useful deasphalted hydrocarbons is reduced when propane is the deasphalting solvent.

Higher molecular weight deasphalting solvents, such as pentane, hexane, and heptane, are better solvents for resins than is propane, and their use in deasphalting results in improved yields of useful deasphalted hydrocarbons. Such higher molecular weight deasphalting solvents reject the asphaltenic contaminants selectively. However, use of these higher molecular solvents results in slower settling of the asphaltenes out of the oil phase. Further, a major difficulty in deasphalting is the large volume of deasphalting solvent which must be employed. It is desirable to reduce the amount of deasphalting solvent required for effective deasphalting operations and to increase the ease and speed of settling out of the flocculated asphaltenes from the oil phase.

It has been unexpectedly found that deasphalting with a higher molecular weight solvent in the presence of added fresh water permits the weight ratio of deasphalting solvent-to-black oil in deasphalting operations to be reduced markedly without effecting the yield or quality of the deasphalted hydrocarbon product and results in more rapid separation of flocculated asphaltenes from the oil phase.

Malikow, et al., German Offenlegungsschrift No. 2,260,777 (June 20, 1974) discloses a method for deasphalting heavy petroleum residues which is similar to the method of this invention. The method of Malikow, et al., involves a liquid-liquid extraction of the heavy petroleum residue with a solvent made up of paraffinic hydrocarbons containing from 4 to 8 carbon atoms, at a pressure higher than the vapor pressure of the solvent, at a temperature between 100° C. and the critical boiling temperature of the solvent, and in the presence of water in an amount of at least 2 volume percent of the heavy petroleum residue.

SUMMARY OF THE INVENTION

This invention is an improvement in the method for treating a heavy hydrocarbon fraction containing ash, asphaltenic, metallic and sulfurous contaminants. The general method involves contacting the heavy hydrocarbon fraction with a liquid paraffinic solvent at an elevated temperature below the critical temperature of the solvent and under a pressure sufficiently high to maintain the solvent in the liquid phase, to thereby form a deasphalted oil phase having a substantially reduced content of ash, asphaltenic, metallic and sulfurous contaminants and an asphalt phase having a substantially greater content of ash, asphaltenic, metallic, and sulfurous contaminants than that in the heavy hydrocarbon fraction.

The improvement comprises contacting the heavy hydrocarbon fraction with a liquid paraffinic solvent containing from about 3 to about 9 carbon atoms per molecule, in a weight ratio of heavy hydrocarbon fraction-to-solvent in the range of from about 1:1 to about 1:15, and preferably in the range of from about 1:2 to about 1:5, at a temperature in the range of from about 70° to about 400° F., and preferably in the range of from about 70° to about 300° F.; and at a pressure in the range of from about 1 atmosphere to about 40 atmospheres gauge, and preferably in the range of from about 1 atmosphere to about 20 atmospheres gauge; and in the presence of water added from an external source at a concentration level in the range of from about 1 to about 40, and preferably from about 5 to about 20, weight percent of water in the heavy hydrocarbon fraction.

Preferably, the heavy hydrocarbon fraction and solvent are contacted in the presence additionally of an oil-water demulsifying agent at a concentration level of from about 1 to about 200, and more preferably from about 5 to about 10, quarts per 1,000 barrels of the heavy hydrocarbon fraction, wherein the demulsifying agent is a nonionic polymeric polyester organic compound or mixtures thereof, and more preferably is a single compound.

The solvent is selected from the class preferably consisting of butane, pentane, hexane, heptane, and mixtures thereof and more preferably consisting of pentane and hexane and mixtures thereof and most preferably is a normal paraffin. The heavy hydrocarbon fraction and solvent are contacted for a period of time preferably in the range of from about 5 minutes to about 2 hours and more preferably in the range of from about 10 to about 20 minutes.

Preferably the deasphalted oil phase and asphalt phase are separated, and more preferably separated by gravitation, filtration, or centrifugation. More preferably the paraffinic solvent is separated from the deasphalted oil phase and asphalt phase, and most preferably separated by flashing or stripping.

DETAILED DESCRIPTION OF THE INVENTION demulsifying chemical to a black oil in deasphalting operations permits the weight ratio of deasphalting solvent-to-black oil in deasphalting operations to be reduced markedly without affecting the yield or quality of the deasphalted oil product and results in more rapid separation of flocculated asphaltenes from the oil phase.

Laboratory tests of the method of this invention are presented in Examples 1–8. The operating conditions used and the results obtained in Examples 1–8 are indicated in Table 1. The feedstock, Feedstock A, used in Examples 1–2 is a tar sands oil containing about 8 weight percent of water and sand. The feedstock, Feedstock B, used in Examples 3–8 is a tar sands oil containing about 14 weight percent of water and sand. Both feedstocks were produced by a combination of forward combustion and water flooding in-situ recovery process, in the Athabasca region of Alberta, Canada, and their properties are tabulated in Table 1. The paraffinic solvent employed in each example is a technical grade of normal pentane. In each example, 200 grams of a oil feedstock, a temperature of 100° F., and a pressure of 1 atmosphere were employed. In Table 1, BS&W represents bottoms sediments and water as measured by ASTM D 96. Ramsbottom carbon was measured by ASTM D 524. The concentration of heptane insolubles shown in Table 1 is a measure of the asphaltene concentration.

TABLE 1

| Example Number | | | 1 | 2 | 3 | 4 | 5 | 6 | 7 | 8 |
|---|---|---|---|---|---|---|---|---|---|---|
| Operating conditions | | | | | | | | | | |
| Solvent-to-oil weight ratio | | | 4:1 | 2:1 | 2:1 | 4:1 | 2:1 | 2:1 | 4:1 | 4:1 |
| Contact time[1] | | | 2 | 2 | 1 | 1 | 1 | 1 | 1 | 1 |
| Water content[2] | | | — | 20 | — | — | 20 | 20 | 20 | 20 |
| Demulsifier content[3] | | | — | 100 | — | — | — | 100 | 100 | 100 |
| Characteristics of hydrocarbon fraction | Feedstock A | Feedstock B | Deasphalted Oil Product | | | | | | | |
| Yield[4] | 100 | 100 | 78.2 | 75.2 | — | 53.3 | 39.3 | 57.0 | 71.4 | 62.9 |
| Gravity[5] | 13.5 | 11.0 | 20.5 | 20.4 | — | 16.1 | 15.9 | 20.9 | 16.4 | 13.2 |
| Pour point[6] | +40 | | −45 | −45 | — | — | — | — | — | — |
| Viscosity[7] | 105 | | 6.6 | 7.1 | — | — | — | — | — | — |
| BS & W[8] | 8.0 | 14.2 | 0.02 | 0.04 | — | — | — | | — | — |
| Sulfur content[9] | 4.5 | | 3.5 | 3.5 | — | — | — | — | — | — |
| Vanadium content[10] | 149 | 160 | 46 | 50 | — | 76 | 58 | 74 | 76 | 126 |
| Nickel content[10] | 63 | 67 | 19 | 24 | — | 31 | 24 | 29 | 33 | 49 |
| Ramsbottom carbon content[9] | 13.7 | | 4.0 | 4.5 | — | — | — | — | — | — |
| Heptane insolubles content[9] | 10.7 | 13.3 | 0.02 | 0.15 | — | 0.98 | 0.05 | 0.31 | 0.13 | 5.2 |
| Salt content[11] | 30 | 82 | 3.4 | 1.8 | — | 6.3 | — | 1.9 | 0.30 | 22 |
| | | | Asphalt Product | | | | | | | |
| Yield[4] | | | 21.8 | 24.8 | — | 46.7 | 60.7 | 43.0 | 28.6 | 37.1 |
| Salt content[9] | | | 0.31 | 0.31 | — | — | — | — | — | — |
| Heptane insolubles[9] | | | — | — | — | 26.96 | 21.53 | — | 62.5 | — |

Footnotes
[1]Hours.
[2]Weight percent of fresh water, based on oil feed.
[3]Quarts of demulsifier per 1,000 barrels of oil.
[4]Weight percent of feedstock.
[5]° API.
[6]° F.
[7]Centistokes at 210° F.
[8]Volume percent.
[9]Weight percent.
[10]Parts per million by weight
[11]Pounds per 1,000 barrels.

Black oils often contain water. For example, typical tar sands contain from about 1 to about 15 weight percent of water. The method of this invention comprises the addition of fresh water and preferably demulsifying agent in deasphalting operations where the objective is to remove ash, asphaltenic, metallic, and sulfurous contaminants from the black oils. It has been found that the addition of fresh water and preferably a Although any oil-water demulsifier which is a nonionic polymeric polyester organic compound or mixture thereof is useful in the method of this invention, the demulsifier used in Examples 2, 6, and 7 is Nalco 537-DA, an emulsion breaking and desalting chemical. Nalco 537-DA is a complex organic compound of the polymeric polyester type containing no chloride or arsenic; having a density at 60° F. of 8.10 pounds per gallon, a viscosity of 40–70 centipoise at 60° F. and of 20–40 centipoise at 90° F., a pour point of −36° F., and being soluble in aromatic or aliphatic solvents which are dispersible in water. The demulsifier used in Example 8 Amoco Chemicals Corporation's RC 952, a desalting compound. Amoco RC 952 is an organic acid ester of a high molecular weight polypropylene triol, wherein adipic acid is an example of the organic acid and a typical molecular weight of the triol is about 3000.

The experimental procedure used in Examples 1–8 involved mixing and heating the oil and solvent in a distillation bulb and total reflux condenser for a period of time, shown as the contact time in Table 1, at a temperature of 100° F. and under atmospheric pressure, and then separating the asphalt phase from the solvent-deasphalted oil phase by vacuum filtration. The water was decanted from the solvent-deasphalted oil phase, and then the solvent was removed from the deasphalted oil phase by batch distillation.

The results shown in Table 1 indicate that the addition of fresh water, and in particular fresh water and a demulsifying agent, in deasphalting operations yield major improvements over the use of solvent alone in deasphalting operations. In particular, the results for Example 3 indicate that, in the absence of added fresh water and demulsifier, the asphalt phase did not separate from the oil phase when the solvent-to-oil weight ratio was only 2:1. Comparison of the results of Examples 3 and 4 indicates that, in the absence of added fresh water and demulsifier, a separation between the deasphalted oil and asphalt phases did not occur until a solvent-to-oil weight ratio of 4:1 was reached.

However, comparison of the results of Examples 3, 5, and 6 indicates that, even with a solvent-to-oil weight ratio of 2:1, a separation between the deasphalted oil and asphalt phases did occur when water was added in deasphalting operations and that the yield of deasphalted oil increased — without sacrificing the quality of the deasphalted oil, especially with regard to contaminant metals — when both fresh water and a demulsifier were added.

Further, comparison of the results for Examples 4 and 6 and of the results for Examples 1 and 2 indicates that, when deasphalting in the presence of added fresh water and a demulsifier, deasphalted oils at similar yields and having similar qualities, particularly with regard to metal contaminants, were obtained at lower solvent-to-oil weight ratios than when deasphalting with solvent alone.

Comparison of the results for Examples 4 and 7 indicates that, at the same solvent-to-oil weight ratio, the addition of fresh water and demulsifying agent in deasphalting operations improved the yield of deasphalted oil without adversely affecting the desired reduction of metal contaminants. Comparison of the results for Examples 6 and 7 indicates that, when deasphalting in the presence of added fresh water and demulsifier, increasing the solvent-to-oil weight ratio from 2:1 to 4:1 caused a substantial increase in the yield of deasphalted oil without sacrificing the quality of the deasphalted oil.

The results in Table 1 indicate that deasphalting in the presence of added fresh water and demulsifier produced a deasphalted oil product having a reduced salt content compared to deasphalting with solvent alone. Deasphalting in the presence of either fresh water or added fresh water and demulsifier produced a deasphalted oil product with a smaller asphaltene content than compared to deasphalting with solvent alone.

The results of Example 8 indicate that the demulsifier used therein was less effective than the demulsifier used in Examples 2, 6, and 7, in regard to desalting and demetalation, but was effective in providing an increased yield of deasphalted oil compared to deasphalting without a demulsifier.

Results of iron analyses are not shown in Table 1. Iron is usually present in black oils as particulate matter and, unlike vanadium and nickel, is not chemically bound. Further, most of the iron is precipitated in the asphalt phase and is virtually entirely removed regardless of process conditions.

A potential application of the method of this invention that would result in increased product of a black oil, for example tar sands oil, and would remove ash, asphaltenic, metallic, sulfurous and salt contaminants therefrom and possibly eliminates the need for an electrical desalter involves injecting an adequate amount of a suitable paraffinic solvent through a pump and into the bottom of the well or deposit. This procedure would result in a lower viscosity and pour point of the black oil and therefore a higher production rate. The addition of paraffinic solvent must be controlled to prevent asphaltene precipitation in the well or deposit.

The black oil-solvent is then withdrawn from the well or deposit and passed to a settler where brine is separated from the black oil-solvent. Then fresh water and the remaining amount of paraffinic solvent that is necessary to precipitate the asphalt phase are added to the black oil-solvent as it passes from the settler to the deasphalting unit. Preferably, a demulsifier is also added with the fresh water.

I claim:

1. In a process for treating a heavy hydrocarbon fraction containing ash, asphaltenic, metallic, and sulfurous contaminants by contacting said heavy hydrocarbon fraction with a liquid paraffinic solvent at an elevated temperature below the critical temperature of said solvent and under a pressure sufficiently high to maintain said solvent in the liquid phase, to form a flocculated asphaltene phase and a deasphalted oil phase having a substantially reduced content of said contaminants than that in the heavy hydrocarbon fraction, the improvement comprising:

a. contacting said heavy hydrocarbon fraction with a liquid paraffinic solvent containing from about 3 to about 9 carbon atoms per molecule, in the presence of a nonionic polymeric polyester organic demulsifying agent and from about 1 to about 40% by weight of added water based on the weight of said heavy hydrocarbon fraction, and at a temperature from about 70° to about 400° F., wherein the ratio of said heavy hydrocarbon fraction to said solvent is from about 1:2 to about 1:5 by weight, and wherein the amount of said demulsifying agent is from about 1 to about 200 quarts per 1000 barrels of said heavy hydrocarbon fraction and b. separating said flocculated asphaltene phase from the deasphalted oil phase.

2. The process as set forth in claim 1 wherein the concentration of said demulsifying agent is in the range of from about 5 to about 10 quarts per 1,000 barrels of the heavy hydrocarbon fraction.

3. The process as set forth in claim 1 wherein said demulsifying agent is an organic acid ester of a high molecular weight polypropylene triol.

4. The process as set forth in claim 1 wherein the pressure is from about 1 atmosphere to about 20 atmospheres gauge.

5. The process as set forth in claim 1 wherein the amount of added water is from about 5 to about 20% by weight based on the weight of said heavy hydrocarbon fraction.

6. The process as set forth in claim 1 wherein said solvent is selected from the group consisting of butane, pentane, hexane, heptane, and mixtures thereof.

7. The process as set forth in claim 1 wherein said solvent is selected from the group consisting of pentane, hexane, and mixtures thereof.

8. The process as set forth in claim 1 wherein the weight ratio of said heavy hydrocarbon fraction to said solvent is about 1:2.

9. The process as set forth in claim 1 wherein the temperature is about 100° F.

10. The process as set forth in claim 1 wherein said heavy hydrocarbon fraction and said solvent are contacted for a period in the range from about 10 to about 20 minutes.

11. The process as set forth in claim 1 wherein said heavy hydrocarbon fraction contains up to about 14 weight percent of water and sand.

* * * * *